US007404603B2

(12) United States Patent
Dewert

(10) Patent No.: US 7,404,603 B2
(45) Date of Patent: Jul. 29, 2008

(54) DRIVE FOR FURNITURE FOR ADJUSTING A FIRST FURNITURE PART IN RELATION TO A SECOND PART

(75) Inventor: Eckhart Dewert, Zürich (CH)

(73) Assignee: Deon AG, Zürich (CH)

( * ) Notice: Subject to any disclaimer, the term of this patent is extended or adjusted under 35 U.S.C. 154(b) by 0 days.

(21) Appl. No.: 11/486,068

(22) Filed: Jul. 14, 2006

(65) Prior Publication Data

US 2006/0253984 A1 Nov. 16, 2006

Related U.S. Application Data

(63) Continuation of application No. PCT/EP2005/000302, filed on Jan. 14, 2005, which is a continuation of application No. PCT/EP2004/000244, filed on Jan. 15, 2004.

(30) Foreign Application Priority Data

Jan. 15, 2003 (DE) ..... 103 01 326

(51) Int. Cl.
*A47C 1/00* (2006.01)

(52) U.S. Cl. ..... 297/330; 297/331; 297/423.28; 297/423.25

(58) Field of Classification Search ..... 297/423.28, 297/423.3, 423.26, 116–118, 130, 105, 111, 297/330, 331, 423.1, 423.25
See application file for complete search history.

(56) References Cited

U.S. PATENT DOCUMENTS 2,790,485 A 4/1957 Franklin
4,127,906 A * 12/1978 Zur ..... 5/615
4,188,677 A * 2/1980 Zur ..... 5/615
4,258,445 A * 3/1981 Zur ..... 5/614
4,287,620 A * 9/1981 Zur ..... 5/615

(Continued)

FOREIGN PATENT DOCUMENTS

DE 3842078 A1 7/1989

(Continued)

OTHER PUBLICATIONS

U.S. Appl. No. 11/030,949, filed Jan. 2005.

(Continued)

*Primary Examiner*—David R Dunn
*Assistant Examiner*—Erika Garrett
(74) *Attorney, Agent, or Firm*—Shlesinger, Arkwright & Garvey LLP

(57) ABSTRACT

Drive for furniture configured for adjusting a first furniture part in relation to a second furniture part the drive includes a pivot shaft, which is pivotally mounted on the first part and with which a pivot drive is operatively associated. The drive includes at least one supporting element which cooperates with the pivot shaft and supports it on a supporting surface provided on the second furniture part, and in such a way that the inclination of the first furniture part can be adjusted in relation to the second part and/or the distance of the first part from the second furniture part can be adjusted. The drive for furniture has a simple construction, is cost-effective to produce, saves a significant amount of space and is particularly suited for adjusting the seat part of a seat, for example.

21 Claims, 8 Drawing Sheets

U.S. PATENT DOCUMENTS

| | | | | | |
|---|---|---|---|---|---|
| 5,156,441 | A * | 10/1992 | Byersmith et al. | ..... | 297/423.28 |
| 5,474,359 | A * | 12/1995 | Muffi | ..... | 297/354.13 |
| 5,829,077 | A | 11/1998 | Neige | | |
| 6,357,065 | B1 * | 3/2002 | Adams | ..... | 5/618 |
| 6,742,205 | B2 | 6/2004 | Dewert | | |
| 6,754,922 | B2 * | 6/2004 | Dewert | ..... | 5/617 |
| 6,763,536 | B2 | 7/2004 | Dewert | | |
| 6,945,131 | B2 | 9/2005 | Dewert | | |
| 6,961,971 | B2 | 11/2005 | Schneider et al. | | |

FOREIGN PATENT DOCUMENTS

| | | | |
|---|---|---|---|
| DE | 298 00 197 | U1 | 4/1998 |
| DE | 199 03 112 | A1 | 2/2000 |
| DE | 299 19 238 | U1 | 4/2000 |
| DE | 201 00 733 | U1 | 4/2001 |
| DE | 100 17 979 | A1 | 7/2001 |
| EP | 1 378 189 | A1 | 1/2004 |
| FR | 2 730 146 | | 8/1996 |

OTHER PUBLICATIONS

U.S. Appl. No. 11/170,091, filed Jun. 2005.
U.S. Appl. No. 11/293,494, filed Dec. 2005.
U.S. Appl. No. 11/293,498, filed Dec. 2005.
U.S. Appl. No. 11/529,588, filed Sep. 2006.
International Search Report dated Mar. 8, 2005 in International PCT Application No. PCT/EP2005/000302, filed Jan. 14, 2005.

* cited by examiner

DRIVE FOR FURNITURE FOR ADJUSTING A FIRST FURNITURE PART IN RELATION TO A SECOND PART

CROSS-REFERENCE TO RELATED APPLICATIONS

This application is a continuation of application no. PCT/EP2005/000302, filed Jan. 14, 2005, which is a continuation of application no. PCT/EP2004/000244, filed Jan. 15, 2004, and which claims priority of German application no. 103 01 326.1, filed Jan. 15, 2003, and each of which is incorporated herein by reference.

FIELD OF THE INVENTION

The invention relates to a drive for furniture for adjusting a first furniture part in relation to a second part.

BACKGROUND OF THE INVENTION

Such drives are generally known and serve, for example, to adjust parts of seating furniture and/or loungers, such as lath grids for beds or of seats.

There are known drives for furniture that serve for adjusting the height and/or inclination of an upholstery element of a seat in relation to a base body of the seat, the upholstery element being configured as a seat part upon which a seat surface is formed. The known drive includes a scissor-like lifting rod, which is connected to a base body and supports the seat part. A drive operated by an electric motor is provided to adjust the lifting rod.

One disadvantage of this known drive for furniture is that it is complicated and therefore expensive to produce. Another disadvantage is that the known drive requires much space, especially beneath the seat part.

OBJECTS AND SUMMARY OF THE INVENTION

An object of the invention is to provide a drive for furniture for adjusting a first part of the furniture in relation to a second part of the furniture, which does not have the disadvantages of known drives, which is simple and cost-effective to produce, and which is configured to save space.

These and other objects are achieved by the teachings and embodiments of the invention set forth herein.

The basic concept of the teachings according to the invention is to provide a pivot shaft drive for adjusting the inclination of a first part, such as a seat part of a seat, in relation to a second part, such as a base body of the seat, and/or the distance of the first part to the second part. For this, there is provided according to the invention at least one pivot shaft, which is associated with a pivot drive and is pivotally mounted on the first part. According to the invention, there is furthermore provided at least one supporting element, which is mechanically linked to the pivot shaft and thanks to which the first pivot shaft supports itself on a supporting surface provided on the second part in such a way that the inclination of the first part in relation to the second part and/or the distance of the first part to the second part can be adjusted by swiveling the pivot shaft.

If the drive for furniture serves, for example, to adjust the inclination of a seat part in relation to a base body of a seat, then, because of the fact that the pivot shaft supports itself on the supporting surface by means of the supporting element or elements, the vertical distance of the pivot shaft from the supporting surface will change when the pivot shaft swivels so that the inclination of the seat part and its distance to the supporting surface are adjusted, thereby adjusting its height.

If according to the invention there is provided, for example, one single pivot shaft that is mounted on an end of the seat part while the other end can swivel around a stationary swiveling axis, then the inclination of the seat part in relation to the supporting surface and therefore in relation to the base body of the seat can be adjusted by means of the drive for furniture according to the invention. If, in contrast, the end of the seat part facing away from the pivot shaft is not mounted on a stationary swiveling axis, but movably mounted by means of a sliding block guide for example, then, by using an appropriate pivoting mechanism, it is possible to adjust not only the inclination but also the height of the seat part in relation to the base body by means of a single pivot shaft.

If, in particular and for example, at least two pivot shafts spaced apart from and parallel to each other are provided with one pivot drive associated with each, then both the height and inclination of the seat part can be adjusted by means of the pivot shafts.

The inventive drive for furniture is simple and cost-effective to produce and saves a significant amount of space. In particular, the drive according to the invention has a particularly small overall height in terms of the pivot shaft and its associated pivot drive.

The drive for furniture according to the invention is suitable for adjusting parts of any furniture, for adjusting parts of a lath grid in relation to each other, for example. The drive according to the invention is particularly good for adjusting parts of seating furniture, especially seats, in relation to each other.

It is basically sufficient according to the invention to provide a single pivot shaft to adjust the inclination of the first part in relation to the second part and/or the distance of the first part to the second part. In an extraordinarily advantageous further development of the teaching according to the invention, however, it is provided that another pivot shaft is provided, this other pivot shaft being spaced apart from and parallel to the pivot shaft and pivotally mounted on the first part and associated with a pivot drive, whereby at least one further supporting element mechanically linked to the other pivot shaft is provided, said supporting element supporting itself in such a way on a supporting surface provided on the second part that the inclination of the first part can be adjusted in relation to the second part and/or the distance of the first part from the second part can be adjusted by swiveling the other pivot shaft. This embodiment results in versatile adjusting options in a simple manner.

If the drive for furniture according to the invention serves, for example, to adjust a seat part of a seat, and if both pivot shafts have the same vertical distance from their respective supporting surface in a start position then, by swiveling the pivot shafts in such a way that the vertical distances of both pivot shafts from their respective supporting surfaces increase by the same amount, the distance of the seat part to the supporting surface, and therefore its height, is adjusted. Here the inclination of the seat part remains unchanged. If one of the pivot shafts is swiveled, thereby increasing or decreasing its vertical distance to its associating supporting surface, while the other pivot shaft is not swiveled, thereby keeping its vertical distance to its associated supporting surface the same, then the inclination of the seat part is adjusted. If, in contrast, the pivot shafts are swiveled in such a way that the vertical distance of both pivot shafts from their respective supporting surface is increased or decreased, then the inclination of the seat part is adjusted.

It is basically sufficient according to the invention to associate only one supporting element to the pivot shaft or other pivot shaft. In an advantageous further development, however, it is provided that at least two supporting elements, which are spaced apart from each other in the axial direction of the respective pivot shaft, are associated with the pivot shaft or at least one of the pivot shafts. This reduces or prevents a camber of the pivot shaft far away from the supporting elements. In the above embodiment, in which another pivot shaft is provided in addition to the pivot shaft, it is particularly advantageous to associate two supporting elements with each of the pivot shafts. In this embodiment, the first part supports itself on four points on the second part. If necessary in accordance with the respective requirements, it is also possible to provide more than two supporting elements per pivot shaft.

In an advantageous further development of the aforementioned embodiment, it is provided that the supporting elements associated with one pivot shaft are mounted on the axial ends of the pivot shaft. In this embodiment, the space between the supporting elements in the radial direction of the pivot shaft remains free, so that the drive saves a significant amount of space.

In another advantageous further development of the teaching according to the invention, it is provided that at least one of the supporting elements includes a journal in the vicinity of the end that is facing away from its associated pivot shaft, this journal guiding the respective supporting element on or into a guide provided on the second part. This embodiment results in a particularly simple construction, wherein it is particularly advantageous that the supporting surface can be mounted next to the respective pivot shaft in the axial direction. If, for example, the first part is a seat part and the second part is a base body of a seat, then the supporting surface associated with a supporting element can, for example, be provided in an armrest of a seat next to the respective pivot shaft in the axial direction, so that the space underneath the seat part remains free.

In advantageous further embodiments of the aforementioned embodiments, it is provided that the journal extends essentially parallel to the axial direction of the associated pivot shaft and/or that the guide is configured as a groove or slot.

In another further development of the embodiment with the journal, it is provided that the open end of the journal points away from the axial center of the associated pivot shaft. If two supporting elements are associated with one pivot shaft, for example, to adjust a seat part in relation to a base body of a seat, then in this embodiment the journals of the supporting elements will point away from each other, whereby the journals can be guided into guides, for example, which are provided in mutually facing surfaces of armrests of the base body. This embodiment results in a construction that saves a significant amount of space, because the space underneath the pivot shaft and therefore the space underneath the seat part is free of parts of the adjustment mechanism. Only the supporting elements project out of the seat part, and they indeed project at the axial ends of the pivot shaft. Since the supporting elements can thus be mounted in the vicinity of the armrests, for example, they will not be visibly perceived or will barely be perceived and not felt as disturbing.

The guide can basically have any shape corresponding to the desired kinematics, a curved shape for example. Advantageously, however, the guide runs essentially straight. This embodiment is particularly simple and therefore cost-efficient to produce.

In another further development of the invention with the guide, it is provided that the longitudinal axis of the guide runs essentially parallel to an imaginary connecting line between the pivot shaft and the other pivot shaft. This embodiment results in particularly simple kinematics.

The supporting element or elements can be configured in any suitable way. In one advantageous further development, it is provided that the supporting element or at least one of the supporting elements is configured as a lever, especially a pivoted lever.

According to the invention, the supporting element can be mechanically linked to the associated pivot shaft in any suitable way. For example, the supporting element can be connected to the associated pivot shaft by means of a toothed gearing, so that a swiveling of the pivot shaft corresponding to the transmission ratio of the gearing leads to a swiveling of the supporting element. To arrange the construction in a particularly simple and therefore cost-efficient manner, one advantageous further development provides that the supporting element or at least one of the supporting elements is connected to the associated pivot shaft in a nonrotatable fashion.

To further reduce the space requirement of the drive for furniture according to the invention, one advantageous further development provides that the supporting element or at least one of the supporting elements is configured flat in the axial direction of the associated pivot shaft.

A manual pivot drive can basically be provided as pivot drive. Advantageously, however, the pivot drive or at least one of the pivot drives is configured to be operated by an electric motor. In this embodiment, the adjustment of the first part in relation to the second part is configured to save strength and to be comfortable.

If more than one pivot shaft is provided according to the invention, then it is possible to provide a common pivot drive according to the invention to swivel the pivot shafts. One advantageous further development of the teaching according to the invention provides that the pivot shaft and the other pivot shaft are each associated with a separate pivot drive in such a way that the pivot shafts swivel independently of one another. In this embodiment, the controls of the pivot drives associated with the pivot shafts can be independent of one another. The control can also be a common control, however, so that predefined kinematics is achieved when adjusting the first part in relation to the second part, for example.

One further development of the embodiment with the pivot drive operated by an electric motor provides that the pivot drive or at least one of the pivot drives is configured as a linear drive comprising an output member moving along a linear axis of motion. These types of linear drives are available as simple and cost-efficient standard components and are suitable for applying large forces. These linear drives may further include other electromechanical drives, depending on the requirements and intended use.

One advantageous further development of the teaching according to the invention provides that the output member is a spindle nut of a spindle drive, the spindle nut being mounted mobile in the axial direction and secure from twisting on a threaded spindle that can be driven in rotation. These types of spindle drives are available as simple and cost-efficient standard components and are suitable for applying large forces.

In a kinematic reversal of the above embodiment, the output member can also be includes a threaded spindle, which is mounted mobile in the axial direction and secure from twisting and upon which there is mounted a stationary spindle nut that can be driven in rotation.

Advantageous means for converting a linear movement of the output member into a swivel movement of the respective pivot shaft are advantageously provided in the above embodiments.

To engineer the means for converting a linear movement of the output member into a swivel movement of the respective pivot shaft in a particularly simple, cost-effective and robust way, an advantageous further development provides that the means for converting a linear movement of the output member into a swivel movement of the respective pivot shaft include a crank-drive-like fitting arrangement, by means of which the output member has a drive connection with the respective pivot shaft.

In the above embodiment, the crank-drive-like or crank drive fitting arrangement advantageously includes a control lever connected to the respective pivot shaft in a nonrotatable fashion, one end of a connecting-rod-like or connecting rod connecting element being eccentrically connected to the pivot shaft by means of this control lever and the other end being articulated connected to the output member.

Another particularly advantageous further embodiment of the teaching according to the invention provides that the furniture is a seating furniture, particularly a seat, that the first part includes an upholstery element, especially a seat part of the seating furniture, and that the second part includes at least one armrest arranged to the side of the upholstery element in the axial direction of the pivot shaft.

One advantageous further development of the abovementioned embodiment provides that the armrest or at least one of the armrests is configured planar and that the guide is provided in an area of the armrest facing the other armrest.

The invention will be described in more detail below based on the enclosed drawing which presents an exemplary embodiment of a drive for furniture according to the invention. All features described or presented in the drawing in themselves or in any combination form the subject matter of the invention, independently of their combination in the claims or their references back and independently of their wording and representation in the description and drawing, respectively.

Relative terms such as up, down, left, and right are for convenience only and are not intended to be limiting. The term furniture and piece of furniture are to be understood as being interchangeable.

DETAILED DESCRIPTION OF THE INVENTION

Figure 1:
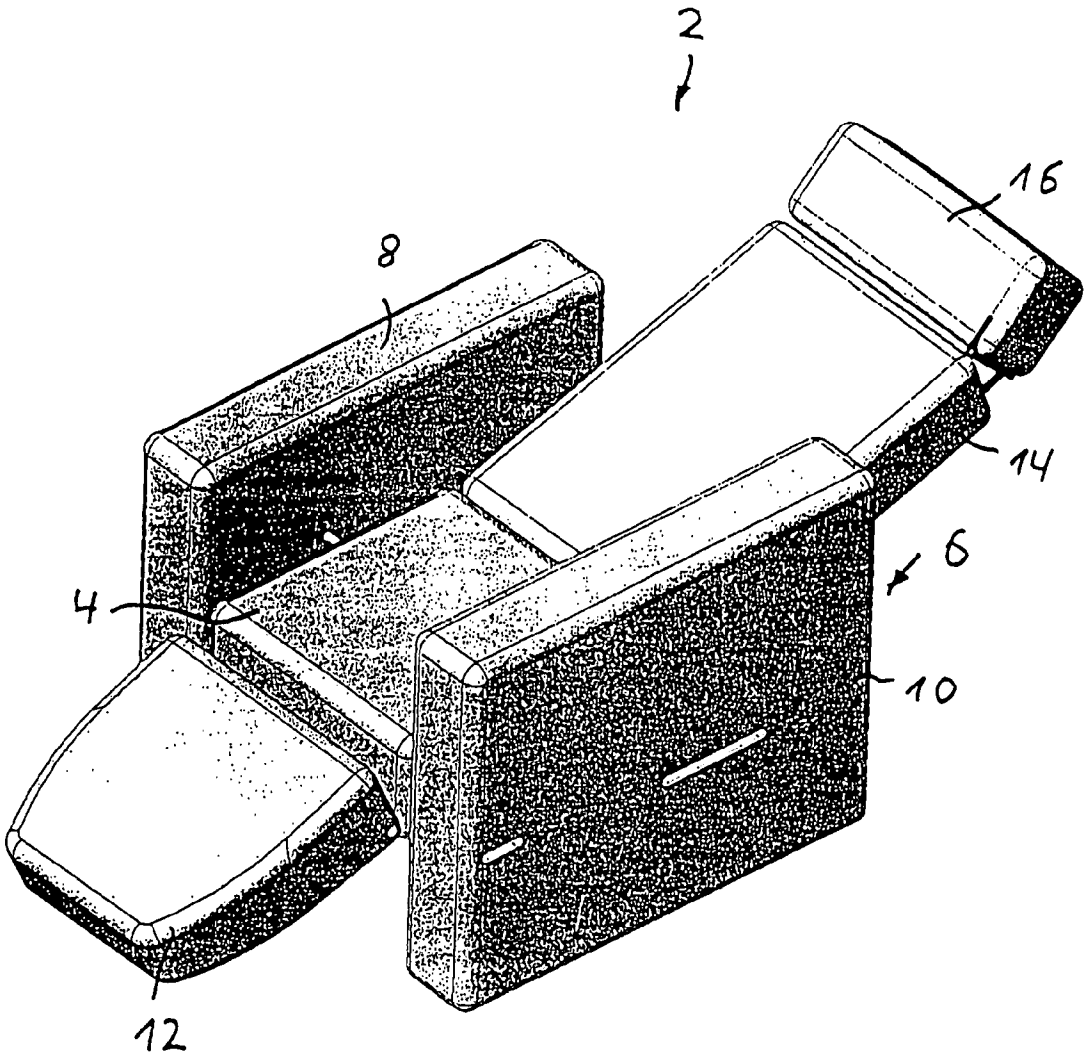
FIG. 1 is a schematic perspective view of an embodiment of furniture according to the invention in the form of a seat equipped with an exemplary embodiment of a drive for furniture according to the invention.

FIG. 1 depicts a first exemplary embodiment of a furniture according to the invention in the form of a seating furniture, namely a seat 2, which includes a first part 4 in the form of a seat part, which is configured as an upholstery element and whose height and inclination can be adjusted in relation to a base body 6 forming a second part of the furniture. A drive for furniture according to the invention, which cannot be discerned in FIG. 1, is provided to adjust the height and inclination of the seat part 4 in relation to the base body 6. The base body 6 includes armrests 8, 10, which are spaced apart and configured substantially planar and located to the sides of seat part 4. Seat 2 furthermore includes a calf part 12 connected articulated to the seat part 4 and an upper body part 14, which is connected articulated to the seat part 4 and connected articulated to the head part 16. The calf part 12, upper body part 14 and head part 16 are not of particular interest here, however, and will therefore not be explained in detail here.

Figure 2:
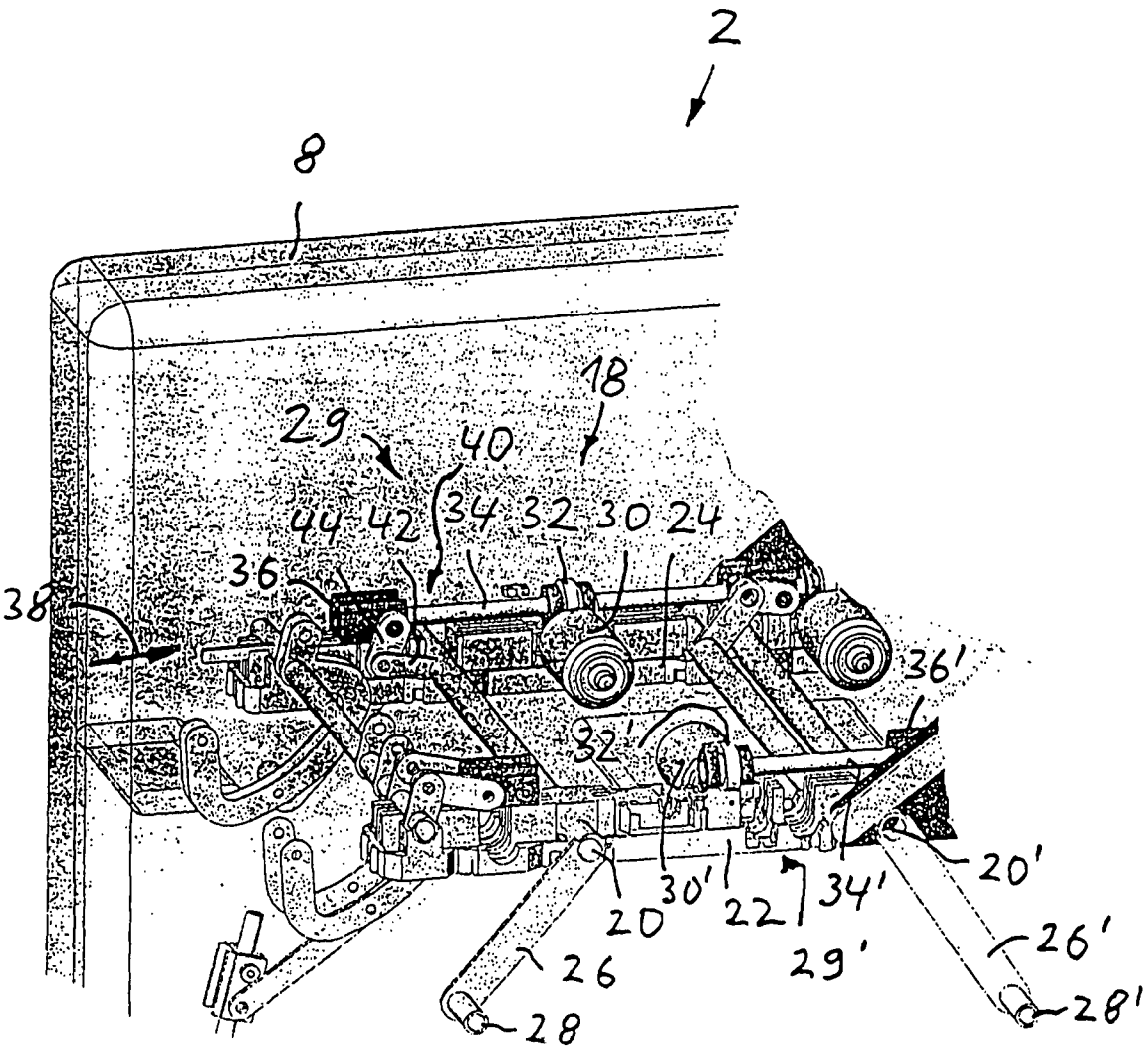
FIG. 2 is a partial perspective view of a drive for furniture according to the invention.

FIG. 2 depicts an exemplary embodiment of a drive for furniture 18 according to the invention for adjusting the seat part 4 in relation to the base body 10, which according to the invention includes a pivot shaft 20 pivotally mounted on the seat part 4. In detail, the pivot shaft 20 is pivotally mounted on longitudinal bars 22, 24 of the seat part 4. The longitudinal bars 22, 24 provide a bearing structure of seat part 4 and are provided with upholstery toward the top of seat part 4 (cf. FIG. 1), the upholstery being omitted in FIG. 2 for reasons of illustration.

The pivot shaft 20 is mechanically linked to a supporting element, in this exemplary embodiment the connection being provided by a pivoted lever 26, whose one end is connected to the pivot shaft 20 in a nonrotatable fashion and which includes a journal 28 in the vicinity of its end facing away from the pivot shaft 20, this journal guiding the pivoted lever 26 into a guide provided in the armrest 10 in a manner explained in more detail below. In this exemplary embodiment, the journal 28 extends essentially parallel to the axial direction of the associated pivot shaft 20, whereby the open end of the journal 28 points away from the axial center of the pivot shaft 20.

In FIG. 2, it is not evident and will therefore be explained in more detail here that another supporting element in the form of another pivoted lever is connected to the axial end of the pivoted shaft 20 that is facing away from the pivoted lever 26, this other supporting element being arranged parallel to the pivoted lever 26. The other pivoted lever is configured in the manner described for the pivoted lever 26, whereby its end that faces away from pivot shaft 20 includes a journal, which corresponds to journal 28 and guides the pivoted lever into a guide provided in the armrest 8.

As evident in FIG. 2, the pivoted lever 26 is configured flat in the axial direction of the associated pivot shaft 20.

An electromechanical pivot drive operated by an electric motor is provided to swivel the pivot shaft 20 and thereby the pivoted lever 26 and the other pivoted lever, this pivoted drive including a drive unit 29 with an electric motor 30 as drive motor, the drive shaft of which, not evident in FIG. 2, is configured as a worm and engages a worm wheel 32. In this exemplary embodiment, the pivot drive includes a linear drive, which is configured as a spindle drive. A threaded spindle 34 of the spindle drive is connected to the worm wheel 32 in a nonrotatable fashion, whereby a spindle nut 36 having an inside thread is mounted on the threaded spindle 34. The spindle nut 36 is mounted to move back and forth on the threaded spindle 34 in the direction of the double-headed arrow 38 along a linear axis of motion in the axial direction of the threaded spindle 34 and is secured against twisting.

In this exemplary embodiment, element(s) according to the invention for converting a linear movement of the output member along the linear axis of motion into a swivel movement of pivot shaft 20 are provided, in this exemplary embodiment this element including a crank-drive-like arrangement 40 that provides a drive connection between the spindle nut 36 and its associated pivot shaft 20. In this exemplary embodiment, the crank-drive-like arrangement 40 includes a control lever 42 which is connected to the pivot shaft 20 in a nonrotatable fashion, one end of a connecting-rod-like connecting element 40 being eccentrically connected to the pivot shaft 20 by means of this control lever and the other end being connected articulated to the spindle nut 36 and eccentric to the pivot shaft 20.

In the exemplary embodiment illustrated in the drawing, the drive for furniture 18 includes another drive unit or further drive 29', which is essentially constructed in the manner described above for the drive unit 29.

The components of the other drive unit 29' are provided with reference signs that correspond to the reference signs of components of drive unit 29.

The other drive unit 29' includes another pivot shaft 20', which is pivotally mounted on the longitudinal bars 22, 24 of the seat part 4. Another pivoted lever 26' is connected to the other pivot shaft 20, the end of the pivoted lever 26' facing away from the pivot shaft 20' including a journal 28' by means of which the other pivot shaft 20' supports itself on a supporting surface by means of the other pivoted lever 26'. The other drive unit 29' includes a linear drive configured as a spindle drive and comprising a spindle drive, the spindle nut 36' of which constitutes the output member of the linear drive and is mounted on a threaded spindle 34', which can be driven in rotation and is connected in a nonrotatable manner to a worm wheel 32', which engages the drive shaft of an electric motor 30', said drive shaft being configured as a worm.

Power supply means, which are not illustrated in the drawing, are provided to supply power to the drive units 29, 29' and control means, which are not illustrated in the drawing, are provided to control the drive units 29, 29'. In this exemplary embodiment, the control means are configured in such a way that the drive units 29, 29' can be driven independently of each other.

Figure 3:
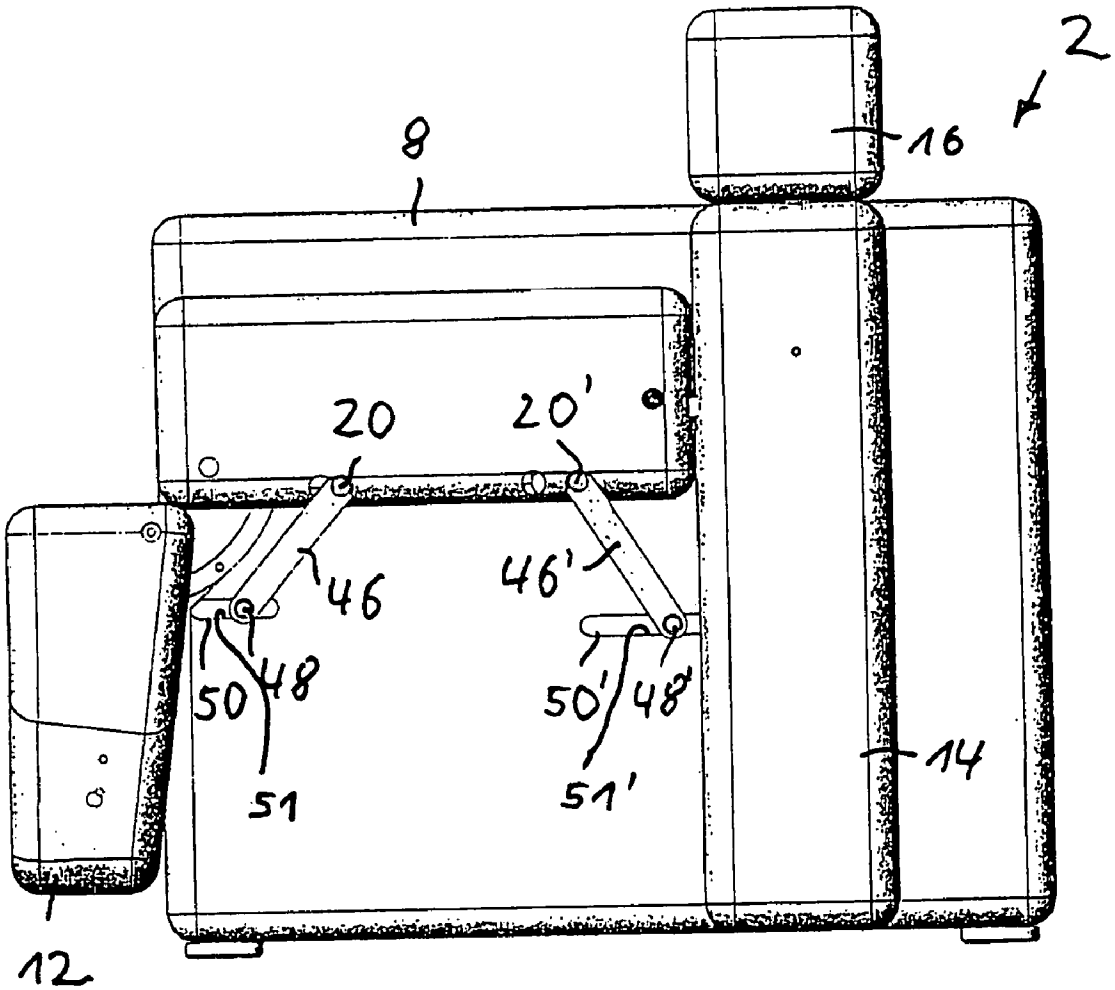
FIG. 3 is a seat according to the embodiment of FIG. 1 in a side view in a first adjustment position, whereby one of the armrests has been left out.

FIG. 3 shows the seat according to FIG. 1, whereby the armrest 10 is omitted for reasons of illustration. It is evident in FIG. 3 that another supporting element in the form of another pivoted lever 46, which is connected to the axial end of pivot shaft 20 facing away from pivoting lever 26, is provided with the pivot shaft 20. The other pivoted lever 46 is configured as described for the pivoted lever 26 on the basis of FIG. 2. On the end facing away from pivot shaft 20, it includes a journal 48, which is guided in a groove-like guide 50 in armrest 8 that is essentially straight and parallel to an imaginary line connecting the pivot shafts 20, 20'. The lower surface 51 of the guide 50 constitutes a supporting surface upon which the pivot shaft 20 is supported by way of the pivoted lever 46. The other pivoted lever 46 is connected to the pivot shaft 20 in a nonrotatable fashion and parallel to the pivoted lever 26.

Another supporting element in the form of another pivoted lever 46', which is constructed as described above for pivoted lever 46' on the basis of FIG. 2, is connected to the other pivot shaft 20'. The other pivoted lever 46' is connected to the pivot shaft 20' in a nonrotatable fashion and it includes, on its end that is facing away from pivot shaft 20', a journal 48', which guides it into a guide 50' provided in the armrest 8, in this exemplary embodiment this guide being essentially straight and parallel to an imaginary connecting line between the pivot shafts 20, 20'.

The method of operation of the inventive drive for furniture will be described below in connection with FIGS. 4 to 7.

Figure 4:
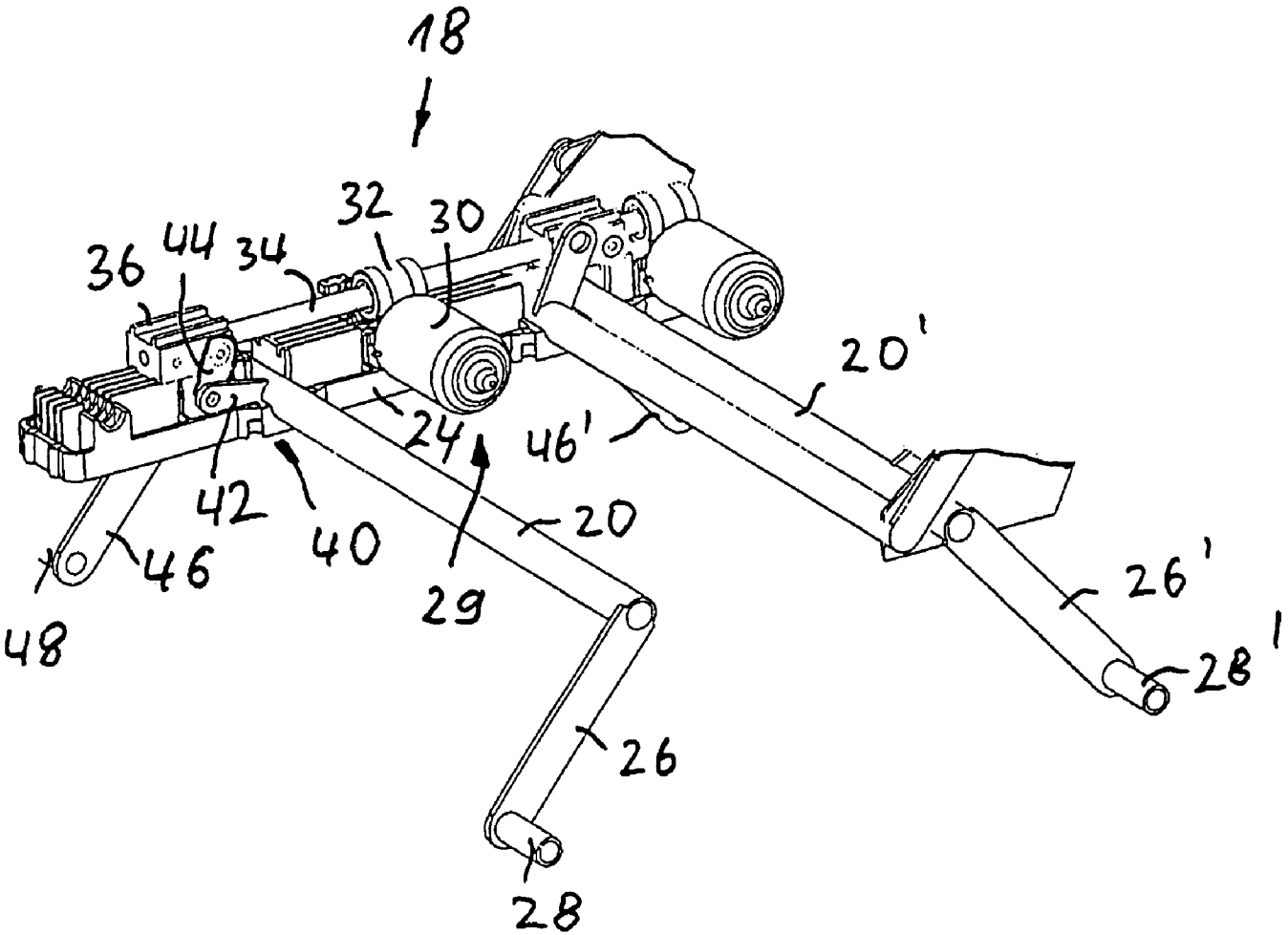
FIG. 4 is another partial perspective view of the drive for furniture according to the embodiment of FIG. 2 in a first adjustment position.
Figure 5:
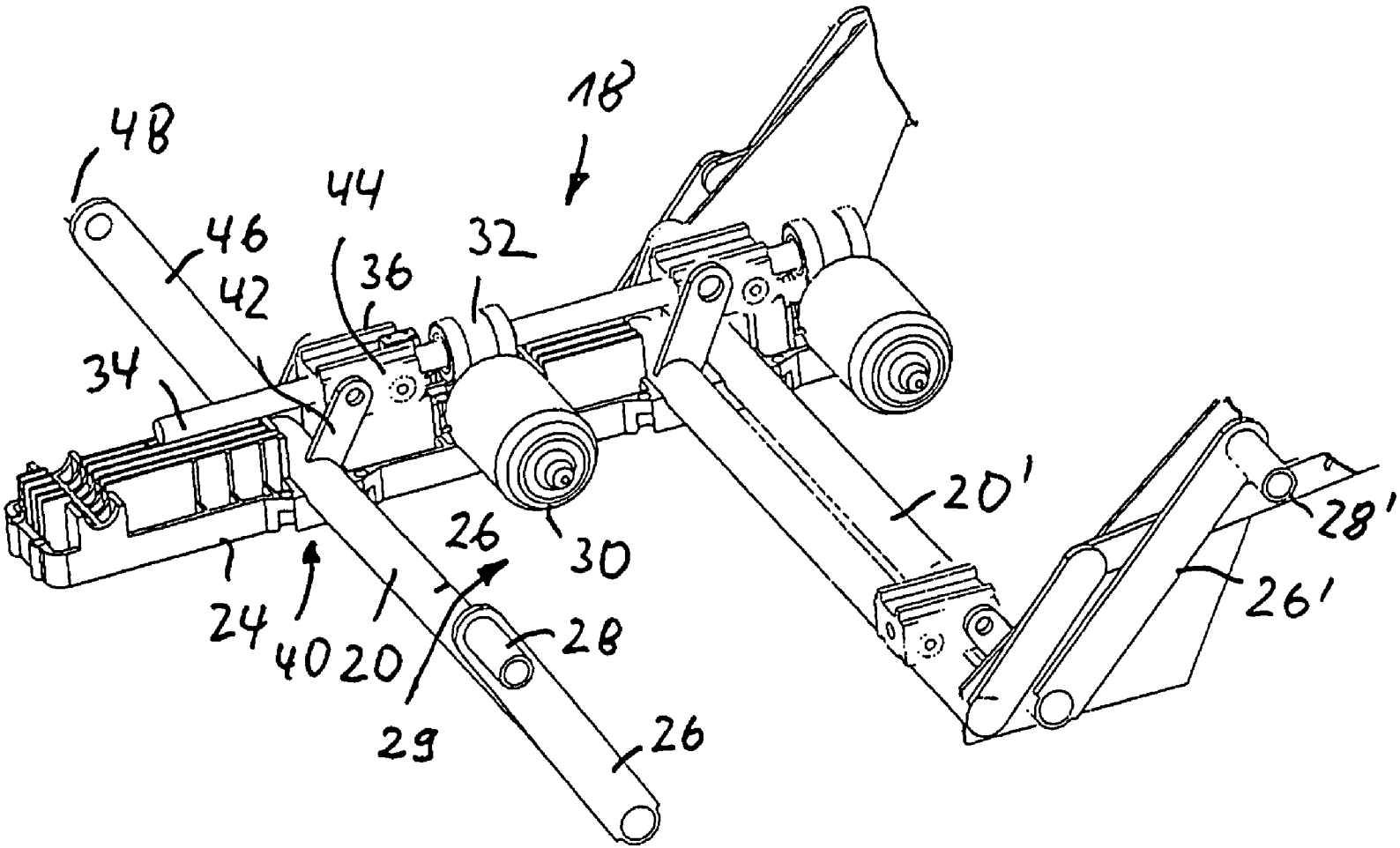
FIG. 5 is the drive for furniture according to the embodiment of FIG. 4 in a second adjustment position.

FIG. 4 shows the drive for furniture 18 in an adjustment position in which the seat part 20 is in a raised position, as illustrated in FIG. 3. In order to lower the seat part 4 out of this raised position, the electric motor 30 drives the threaded spindle 34 in such a way that the spindle nut 36 in FIG. 4 moves to the right. During the movement to the right in FIG. 4, the spindle nut 36 swivels the control lever 42 of the crank-drive-like arrangement 40 in FIG. 4 clockwise. As the control lever 42 is connected to the pivot shaft 20 in a nonrotatable fashion, the pivot shaft 20 in FIG. 4 likewise swivels clockwise. As the connection of the pivoted levers 26, 46, which constitute the supporting elements, is nonrotatable, the pivoted levers 26, 46 likewise swivel clockwise in FIG. 4 until the stop position of the swivel movement, depicted in FIG. 5, has been reached. Since the pivoted levers 26, 46 support themselves on the supporting surface 51 of the respectively associated guide (cf. FIG. 3 for pivoted lever 46) with their journals 28 and 48 respectively, the vertical distance of pivot shaft 20 to an imaginary line running in the longitudinal direction of guide 50 decreases when the pivoted lever 46 swivels, so that the end of seat part 4 facing calf part 12 is lowered.

Figure 6:
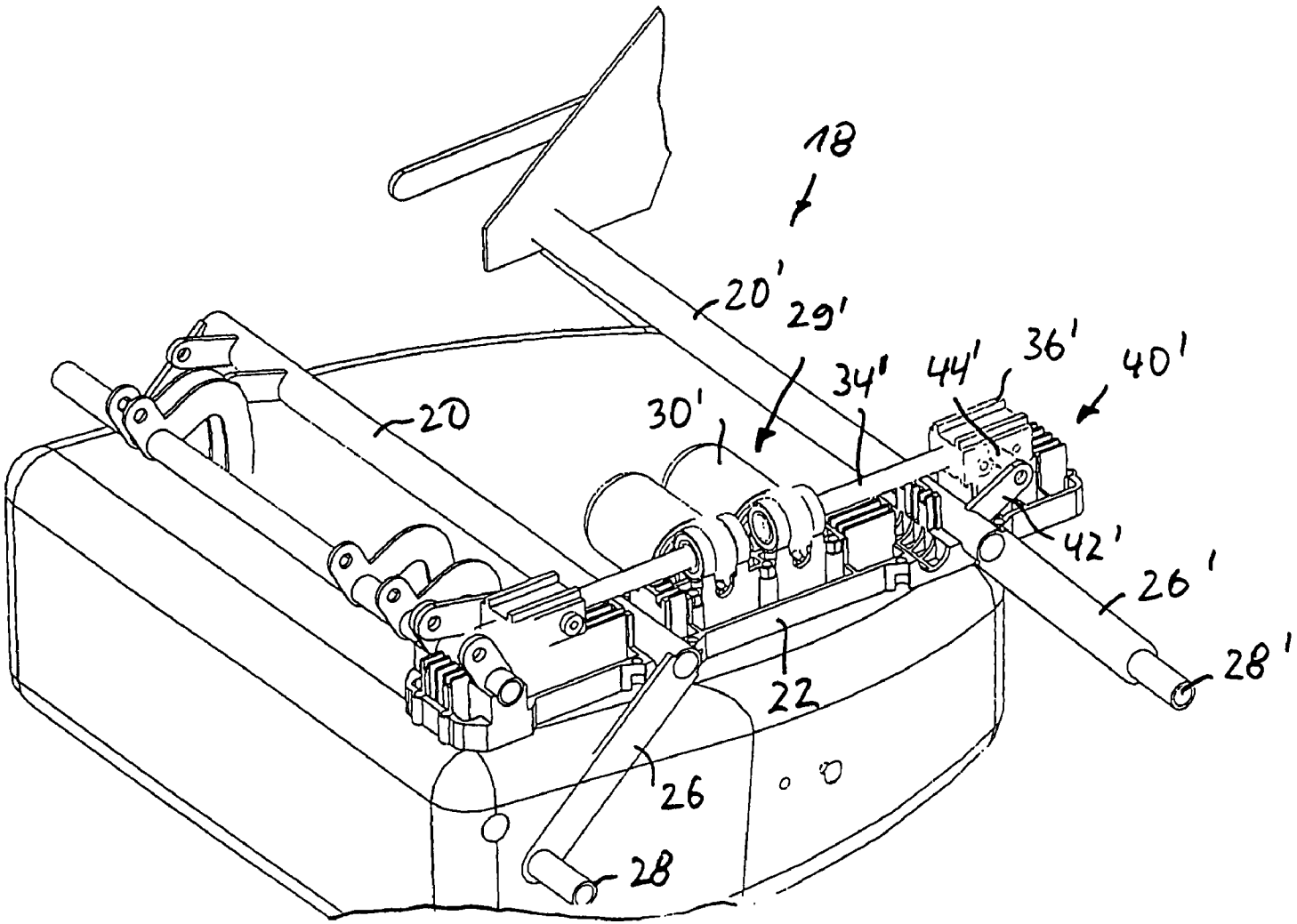
FIG. 6 is another perspective partial representation of the drive for furniture according to the embodiment of FIG. 2.
Figure 7:
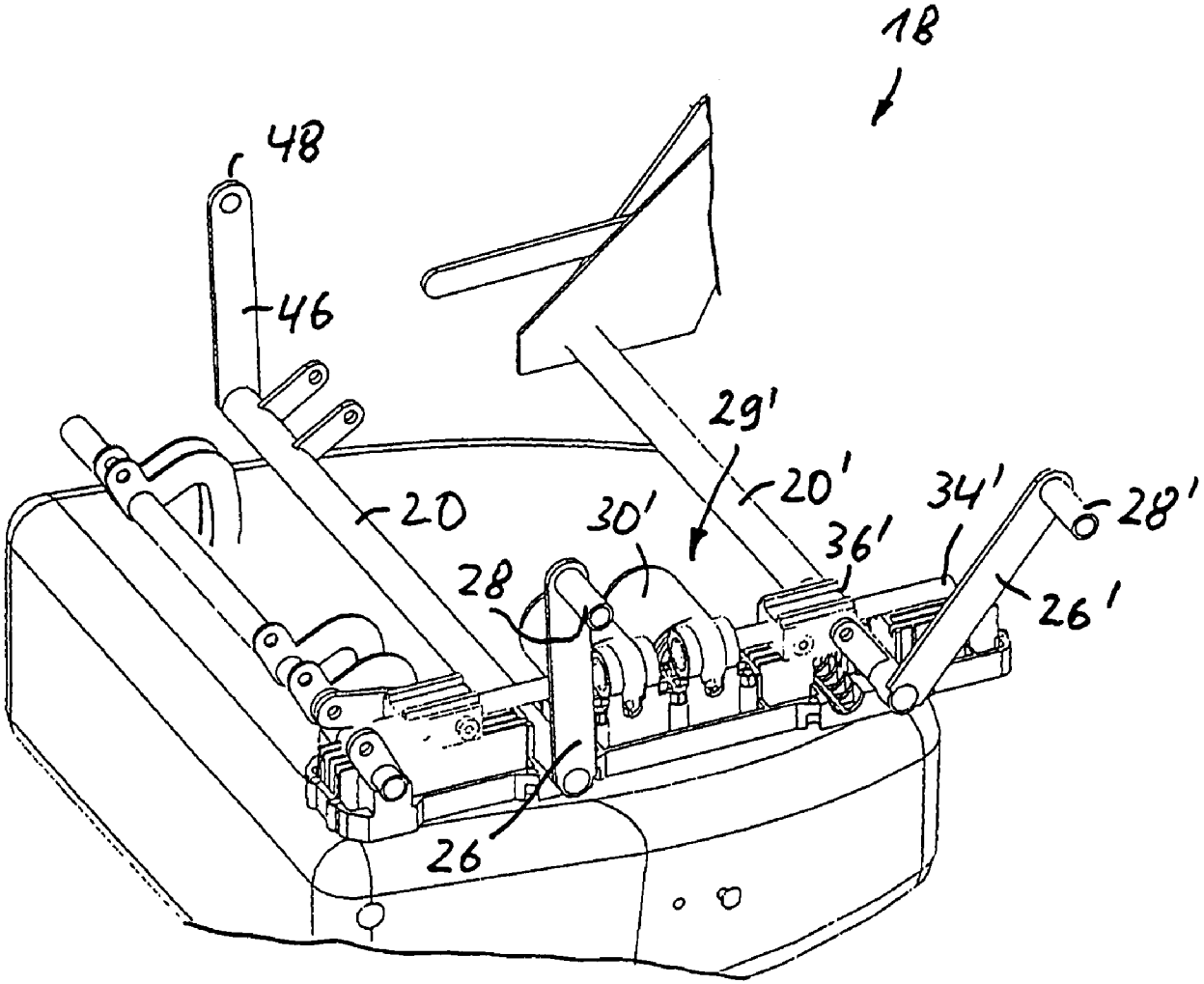
FIG. 7 is the drive for furniture according to the embodiment of FIG. 6 in the same representation as in FIG. 6 in a second adjustment position.

At the same time, the electric motor 30' of drive unit 29', which can be seen in FIG. 6, drives the threaded spindle 34' in such a way that the spindle nut 36' in FIG. 6 moves to the left. In doing so, the spindle nut 36' swivels the control lever 42' of the crank-drive-like arrangement 40' in FIG. 6 counterclockwise, so that pivot shaft 20' likewise swivels counterclockwise in FIG. 6. Since the connection of pivoted levers 26', 46', which constitute the supporting elements, to the pivot shaft 20 is nonrotatable, the pivoted levers 26', 46' in FIG. 6 swivel counterclockwise until the stop position of this swivel movement, illustrated in FIG. 7, has been reached. Since the pivoted levers 26', 46', using their associated journals 28' and 48' respectively, support themselves on the supporting surface provided on guide 50', the end of the seat part 4 facing away from the calf part 12 is lowered during this swivel movement.

Figure 8:
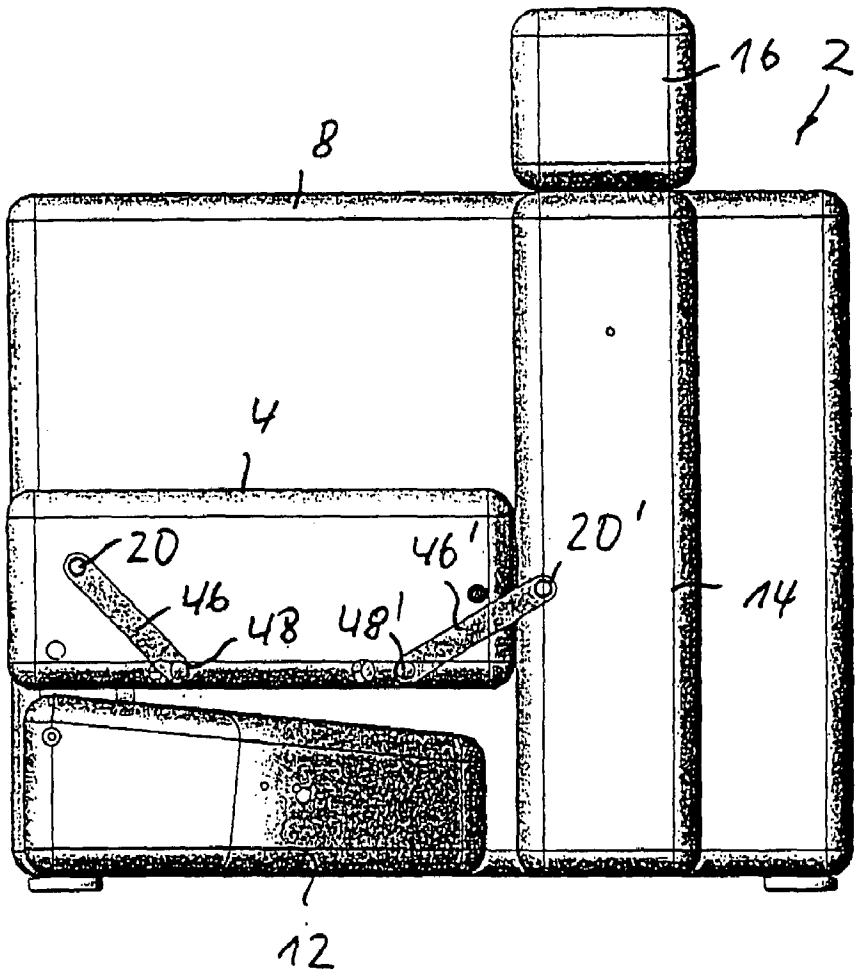
FIG. 8 is the seat according to the embodiment of FIG. 3 in the same representation as in FIG. 3 in a second adjustment position.

If the drive unit 29 and drive unit 29' are driven synchronously, then the seat part is lowered out of the raised adjustment position depicted in FIG. 3 into the adjustment position depicted in FIG. 8.

Another lifting of the seat part 4 into the raised position is accomplished by driving the drive unit 29, 29' oppositely. During a synchronous drive of the drive units 29, 29', the inclination of the seat part 4' remains constant during the height adjustment.

If the inclination of the seat part 4 is to be adjusted in relation to the base body 6, this can be accomplished for example, by only driving the drive unit 29 while the drive unit 29' remains stopped so that, proceeding from the adjustment position depicted in FIG. 3, the pivoted lever 46 in FIG. 3 will swivel clockwise and the end of the seat part 4 facing the calf part 12 will be lowered. If, in contrast, the end of seat part 4 facing away from the calf part 12 is to be lowered, then the drive unit 29' is driven in such a way that the pivoting lever 46' in FIG. 3 swivels counterclockwise while drive unit 29 remains stopped.

The drive for furniture 18 according to the invention is simple and cost-effective in construction and robust. A special advantage is that only pivoted levers 26, 26' and 46, 46', which are very narrow in the axial direction of the pivot shafts 20, 20', protrude toward the underside of the seat part 4. The pivoted levers 26, 26' and 46, 46' are located in the direct vicinity of armrests 6, 8 and will not be visibly perceived or will barely be perceived both in the raised position of seat part 4 depicted in FIG. 3 and also in the lowered position of seat part 4 depicted in FIG. 8. Since no other components of the adjustment mechanism project downwards above the seat part 4 along the entire axial expansion of pivot shafts 20, 20', the entire space underneath seat part 4 is free. Since the drive units 29, 29' are furthermore integrated overshoot-free into the seat part 4, the drive for furniture according to the invention is barely visible in spite of versatile adjustment options in height and inclination. The seat 2 according to the invention therefore includes a particularly appealing appearance, which barely differs from the visible appearance of a non-adjustable seat.

While this invention has been described as having a preferred configuration, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

The invention claimed is:

1. Drive for furniture for adjusting a first part of a furniture in relation to a second part of the furniture, in use, the drive comprising:

a) a pivot drive;

b) a first pivot shaft, operatively associated with the pivot drive and pivotally mountable on the first part of a furniture; and c) a first supporting element mechanically linked to the first pivot shaft and by which the first pivot shaft is supportable on a supporting surface provided on the second part of a furniture in such a way that at least one of:

i) the inclination of the first part in relation to the second part of the furniture, in use, and ii) the distance of the first part to the second part of a furniture can be adjusted by swiveling the first pivot shaft, in use;

d) a further pivot shaft being provided, the further pivot shaft being spaced apart from and parallel to the first pivot shaft, and the further pivot shaft being pivotally mountable on the first part of a furniture and operatively associated with the pivot drive;

e) a further supporting element being mechanically linked to the further pivot shaft;

f) the further supporting element being supportable on a supporting surface provided on the second part in such a way that at least one of:

i) the inclination of the first part of a furniture can be adjusted in relation to the second part of a furniture, in use, and ii) the distance of the first part from the second part of a furniture can be adjusted by swiveling the further pivot shaft, in use; and g) the first supporting element and the further supporting element are spaced apart from each other in the axial direction of their respective pivot shafts, said first supporting element being operatively associated with the first pivot shaft, and said second supporting element being operatively associated with said further pivot shaft.

2. Drive for furniture according to claim 1, wherein:

a) the first and further supporting elements operatively associated with the first pivot shaft are mounted on the axial ends of the first pivot shaft.

3. Drive for furniture according to claim 1, wherein:

a) one of the first supporting element and the further supporting element includes a journal in the region of an end facing away from its associated pivot shaft, the journal guiding the respective first and further supporting element one of on and into a guide provided on the second part of a furniture.

4. Drive for furniture according to claim 3, wherein:

a) the journal extends substantially parallel to the axial direction of its associated pivot shaft.

5. Drive for furniture according to claim 3, wherein:

a) the guide is configured as one of a groove and a slot.

6. Drive for furniture according to claim 3, wherein:

a) an open end of the journal points away from the axial center of the associated pivot shaft.

7. Drive for furniture according to claim 3, wherein:

a) the guide runs substantially straight.

8. Drive for furniture according to claim 3, wherein:

a) the longitudinal axis of the guide runs substantially parallel to an imaginary connecting line between the first pivot shaft and the further pivot shaft.

9. Drive for furniture according to claim 1, wherein:

a) one of the first supporting element and the further supporting element includes a pivoted lever.

10. Drive for furniture according to claim 1, wherein:

a) one of the first supporting element and the further supporting element is connected to the associated first and further pivot shaft in a nonrotatable fashion.

11. Drive for furniture according to claim 1, wherein:

a) one of the first supporting element and the further supporting element is configured flat in the axial direction of the associated first and further pivot shaft.

12. Drive for furniture according to claim 1, wherein:

a) the pivot drive is configured to be operated by an electric motor.

13. Drive for furniture according to claim 12, wherein:

a) the pivot drive is configured as a linear drive including an off-drive member moving along a linear axis of motion.

14. Drive for furniture according to claim 13, wherein:

a) the off-drive member includes a spindle nut and a rotatable spindle drive, the spindle nut being mounted movably in the axial direction and nonrotatably on the rotatable spindle drive.

15. Drive for furniture according to claim 13, wherein:

a) the off-drive member includes a linearly movable, nonrotatable spindle drive movable in the axial direction, and on which there is mounted a stationary, rotatable spindle nut.

16. Drive for furniture according to claim 13, wherein:

a) an element is provided that is configured for converting a linear movement of the off-drive member into a swivel movement of the first and further pivot shafts, respectively.

17. Drive for furniture according to claim 16, wherein:

a) the element for converting a linear movement of the off-drive member into a swivel movement of the respective first and further pivot shaft includes a crank drive fitting arrangement configured for providing a drive connection between the off-drive member and the first and further pivot shafts, respectively.

18. Drive for furniture according to claim 17, wherein:

a) the crank drive fitting arrangement includes a control lever connected to the first and further pivot shafts, respectively, in a nonrotatable fashion, and one end of a connecting rod connecting element being eccentrically connected to the respective pivot shaft thanks to this control lever and the other end being articulatedly connected to the off-drive member.

19. Drive for furniture according to claim 1, wherein:

a) the first pivot shaft and the further pivot shaft are each operatively associated with a separate pivot drive in such a way that the first and further pivot shafts swivel independently of one another.

20. Drive for furniture according to claim 1, wherein:

a) the furniture includes a seat, the first part includes a seat part of the seat, and that the second part includes an armrest arranged to a side of the seat part of the seat in the axial direction of the first pivot shaft.

21. Drive for furniture according to claim 20, wherein:

a) a guide is provided on the second part of a furniture; and b) the armrest of the seat is configured planar, and the guide is provided in an area of the armrest facing a further armrest.

* * * * *